US010531531B2

(12) United States Patent
Wang et al.

(10) Patent No.: US 10,531,531 B2
(45) Date of Patent: Jan. 7, 2020

(54) DIGITAL DIMMING SOLUTION FOR LED APPLICATIONS INCLUDING A PHASE-CUT DIMMER

(71) Applicant: DIALOG SEMICONDUCTOR INC., Campbell, CA (US)

(72) Inventors: Xiaoyan Wang, Campbell, CA (US); Nan Shi, Campbell, CA (US)

(73) Assignee: DIALOG SEMICONDUCTOR INC., Campbell, CA (US)

( * ) Notice: Subject to any disclaimer, the term of this patent is extended or adjusted under 35 U.S.C. 154(b) by 213 days.

(21) Appl. No.: 15/399,582

(22) Filed: Jan. 5, 2017

(65) Prior Publication Data

US 2017/0196062 A1 Jul. 6, 2017

Related U.S. Application Data

(60) Provisional application No. 62/275,542, filed on Jan. 6, 2016.

(51) Int. Cl.
*H05B 33/08* (2006.01)
*H05B 37/02* (2006.01)

(52) U.S. Cl.
CPC ..... *H05B 33/0845* (2013.01); *H05B 33/0815* (2013.01); *H05B 37/0272* (2013.01)

(58) Field of Classification Search
CPC ..... H05B 33/0815; H05B 33/0845; H05B 33/0887
USPC ..... 315/307, 308
See application file for complete search history.

(56) References Cited

U.S. PATENT DOCUMENTS

2008/0116818 A1* 5/2008 Shteynberg ..... H05B 33/0815 315/192
2012/0104974 A1* 5/2012 Saes ..... H05B 33/083 315/297
2013/0154496 A1* 6/2013 Maru ..... H02M 1/44 315/210
2014/0103838 A1* 4/2014 Zheng ..... H05B 33/0815 315/307
2016/0066386 A1* 3/2016 Catalano ..... H05B 33/0854 315/309
2016/0345414 A1* 11/2016 Nolan ..... G08C 17/02

* cited by examiner

*Primary Examiner* — Douglas W Owens
*Assistant Examiner* — Amy X Yang
(74) *Attorney, Agent, or Firm* — Haynes and Boone, LLP

(57) ABSTRACT

A system and method for controlling a light output from a LED-based lighting solution is provided that may receive phase-cut AC signals and/or external digital control signals. The invention is capable of receiving both a phase-cut AC signal and an external digital control signal simultaneously and providing a desired light output from a LED-based lighting solution. The system generally includes a power source electronically connected to one or more dimmers and an AC power output of the dimmer connected to a solid state lighting device such as an LED. The system is capable of receiving signals from a wired and/or wireless external digital control device to additionally control the desired light output from a LED-based lighting solution.

18 Claims, 10 Drawing Sheets

DIGITAL DIMMING SOLUTION FOR LED APPLICATIONS INCLUDING A PHASE-CUT DIMMER

CROSS-REFERENCE TO RELATED APPLICATIONS

This application claims the benefit of U.S. Provisional Application No. 62/275,542, filed Jan. 6, 2016, the contents of which are incorporated by reference herein in their entirety.

TECHNICAL FIELD

This invention is in the field of Solid State Lighting (SSL), and more particularly to circuits and techniques for digital dimming of SSLs in the presence of analog phase-cut dimming.

BACKGROUND

Providing dimming capabilities to lighting applications saves energy and enhances ambiance. Thus, a substantial portion of the lighting infrastructure for both residential and commercial applications includes some form of dimming such as a phase-cut dimmer. Phase-cut dimmers function by isolating the light fixture from the AC mains during part of the AC cycle. If the AC main cycles at 60 Hz, the phase-cut dimmer would thus isolate the light fixture at a 120 Hz rate. The phase cutting is defined with regard to the zero crossing of the AC mains. If the phase cutting begins at the zero crossing, the resulting phase-cut dimmer is denoted as a leading-edge dimmer. If the phase cutting ends at the zero crossing, the resulting phase-cut dimmer is denoted as a trailing-edge dimmer.

An incandescent or fluorescent bulb may be directly powered by a phase-cut dimmer without any modification. But incandescent and fluorescent bulbs are being rapidly replaced by light emitting diode (LED)-based lighting solutions due to the improved efficiency, longer usable lifespan, and lack of toxic materials in LEDs. However, the replacement of incandescent (or fluorescent) bulbs by LEDs leads to some integration issues with regard to being powered through a phase-cut dimmer. Regardless of whether the phase-cut dimmer is a leading-edge or a trailing-edge dimmer, a conventional LED cannot typically be powered through a phase-cut dimmer without some adaptations. For example, an incandescent bulb filament cools relatively slowly and thus continues to output light during the periods in which the phase-cut dimmer isolates the incandescent bulb from the AC mains. In contrast, an LED fixture reacts very rapidly to the current isolation through the phase-cut dimmer. A conventional LED will thus be prone to flicker and other disconcerting issues if powered through a phase-cut dimmer without further adaptations. In addition, LED fixtures typically require a bleeder circuit to provide a sufficient latching current for a phase-cut dimmer such as a triac device.

As compared to the analog dimming applied through a phase-cut dimmer, LED fixtures are more readily dimmed through digital approaches in which the power-switch controller for the switching power converter for the LED applies the dimming. For example, the Zigbee alliance has promulgated a standard denoted as the Zigbee Light Link for wirelessly controlling the digital dimming of LED fixtures. But these digital approaches function as an alternative to phase-cut dimmers. The combination of conventional digital control of LED dimming and phase-cut dimming results in flicker, multi-firing, phase angle distortion, and other undesirable effects.

Accordingly, there is a need in the art for improved digital LED dimming techniques and systems that are compatible with the presence of a phase-cut dimmer.

SUMMARY

A controller for controlling the cycling of a power switch in a switching power converter is configured to respond to both analog and digital dimming commands. In particular, the controller includes a phase-angle sensor for determining the amount of phase-cut angle from a phase-cut dimmer. Based upon the analog dimming application in a preceding cycle of a rectified input voltage during the preceding cycle, the controller determines a number of constant current pulses that will be driven through the power switch in a current cycle of the rectified input voltage. The controller is further configured to adjust the number of constant current pulses responsive to a digital dimming command. In this fashion, digital and analog dimming techniques are combined without the conventional risk of flicker, multi-firing, phase angle distortion and other undesirable effects.

These advantageous features may be better appreciated through a consideration of the following detailed description.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

Figure 1:
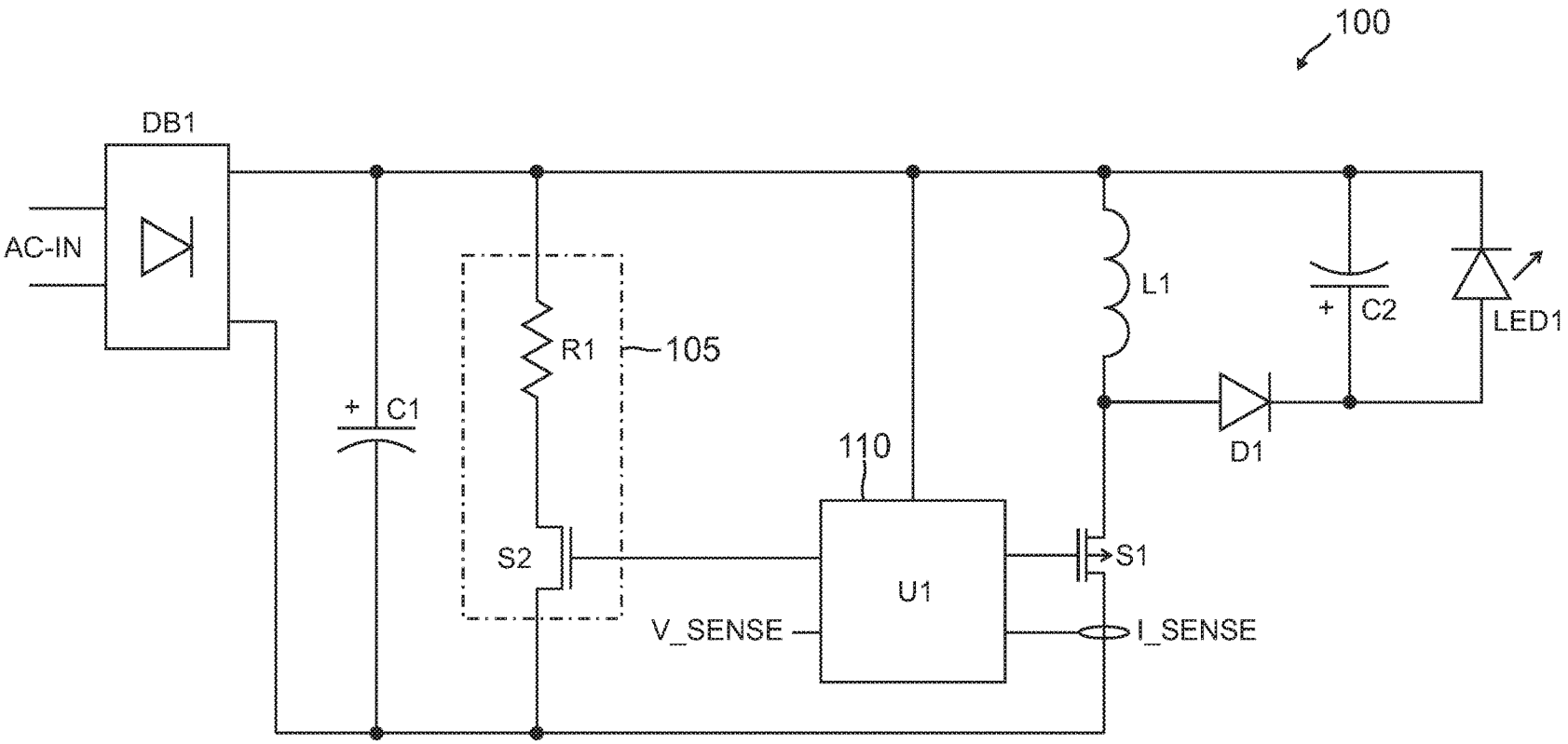
FIG. 1 an example Solid State Lighting (SSL) system including a controller configured to respond to both analog and digital dimming commands.

The following discussion will be directed to a non-isolated buck-boost power converter having a controller configured for digital dimming in the presence of a phase-cut dimmer. But it will be appreciated that the resulting digital control techniques may be widely applied to other types of switching power converters such as flyback converters that must power an LED fixture through a phase-cut dimmer. Turning now to the drawings, FIG. 1 shows an LED fixture 100 that includes a buck-boost power converter. A diode bridge DB1 and a bulk capacitor C1 provide an unregulated DC voltage from the phase-cut AC mains voltage (the phase-cut dimmer is not shown for illustration clarity). An inductor L1, a power switch transistor S1, and a controller U1 comprise the power stage. An output stage is comprised of a rectifier diode D1 and an output capacitor C2. An output voltage across output capacitor C2 powers an LED (LED1). Controller U1 regulates the output voltage (or output current) by controlling the on and off cycles of power switch transistor S1. A bleeder circuit 105 includes a resistor R1 in series with a bleeder switch transistor S2. In alternative embodiments, bleeder circuit 105 instead is implemented through a time-division multiplexing of the power switch transistor S1. In such embodiments, however, bleeder switch transistor S2 would instead be coupled in parallel with the sense resistor so that the sense resistor can be bypassed when the power switch S1 is used to conduct bleeder current. Controller U1 thus implements the cycling of power switch transistor S1 as well as a cycling of bleeder switch transistor S2 within bleeder circuit 105 regardless of the bleeder circuit embodiment. It will be appreciated that separate integrated circuits may be used to perform these functions as explained further herein.

Figure 2:
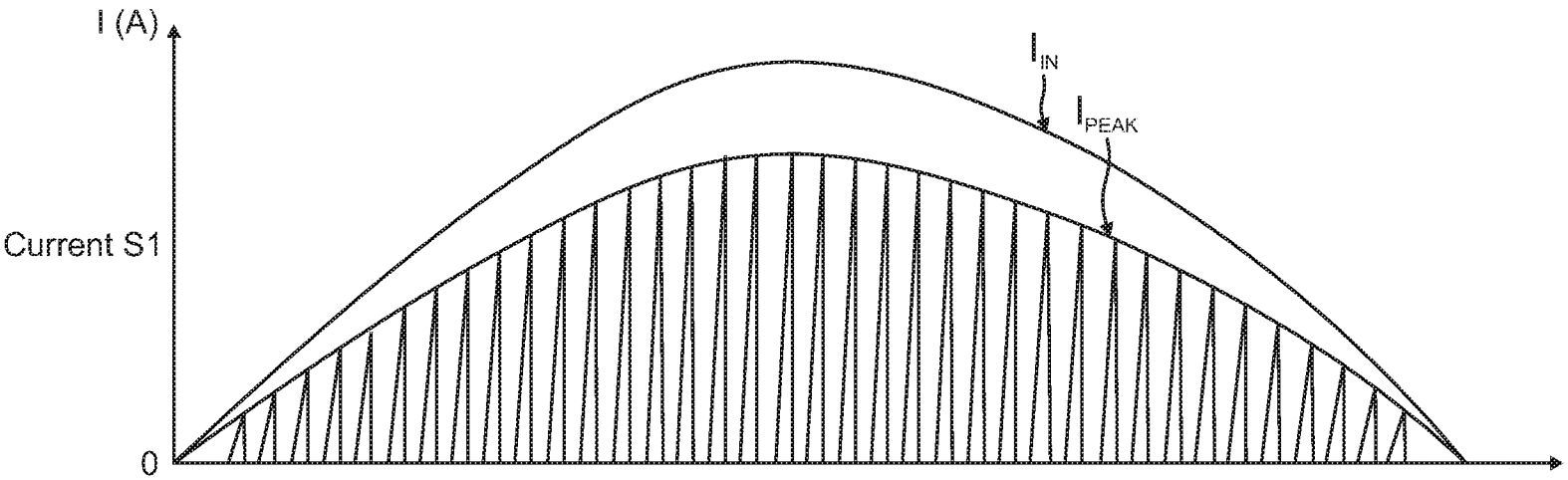
FIG. 2 shows operational waveforms of the SSL shown in FIG. 1 during a period of no digital or analog (phase-cut) dimming.

During periods of no dimming (neither digital nor analog), controller U1 may operate using conventional peak-current control. In that regard, controller U1 senses the peak current through inductor L1 during each on cycle of power switch transistor S1 through an input signal I_SENSE that may be obtained from, for example, a sense resistor (not illustrated). The input current from the AC mains without any phase-cut dimming is sinusoidal as shown in FIG. 2. To provide a suitably high power factor, controller U1 controls the peak current for each cycle of the power switch transistor S1 to mimic this sinusoidal profile as also shown in FIG. 2. Raising or lowering the I_Peak threshold envelope achieves output regulation. This control scheme is commonly referred to as current shaping. The output regulation from controller U1 maintains a constant light output regardless of the AC mains input voltage. But controller U1 departs from this peak current control methodology in the presence of digital dimming and/or phase-cut dimming as explained further herein.

Figure 3:
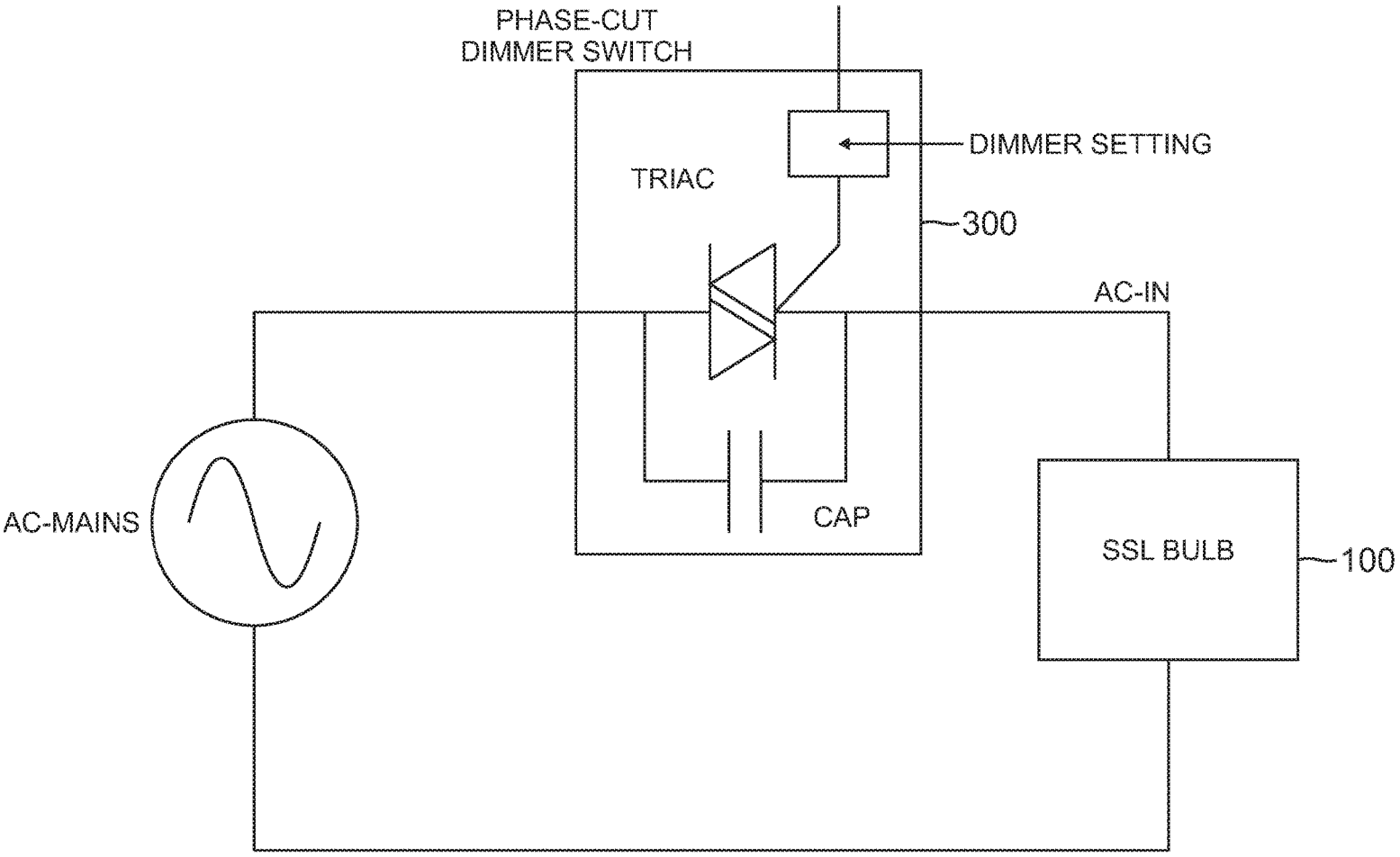
FIG. 3 illustrates the SSL system of FIG. 1 including a phase-cut dimmer.

The integration of LED fixture 100 with a phase-cut dimmer 300 is shown in FIG. 3. In this embodiment, phase-cut dimmer 300 comprises a triac device that performs a leading-edge phase-cut of the AC input current from the AC mains. When the triac device is conducting electricity, a minimum holding current is required to maintain the triac in the conducting state. Because incandescent lighting solutions typically present a linear resistive load and are relatively inefficient, maintaining the minimum holding current and keeping a triac device in the conducting state is usually not a problem for an incandescent application. However, in the case of LED-based lighting solutions, which typically present substantially non-linear resistive loads and are much more efficient, maintaining a minimum load while the triac is in the conducting/on state is more complicated. The increased efficiency of the LED fixture may cause the triac to misfire (conduct insufficient holding current) over the whole conduction angle. Moreover, different triac devices often have different minimum holding currents that further complicate the design of LED-based lighting solutions for use with dimmer switches. If the minimum holding current is not met, the triac device resets thereby prematurely switching to the off state. This can cause light flicker, color shifting, and/or complete failure of the LED-based lighting solution.

To insure the triac device remains in the on state as defined by the dimming setting, it is conventional for LED-based lighting solutions to include a bleeder circuit such as bleeder circuit 105 shown in FIG. 1. A bleeder circuit adds to the over-all load that the SSL draws from the AC power circuit. One use of a bleeder circuit is to provide the necessary current to keep the triac device in the on state at the desired periods. Another use of a bleeder circuit is to aid LED-based lighting solutions in detecting the phase angle of the AC input voltage. After detecting the phase angle of the AC input voltage after the triac of the dimmer switch starts to conduct, and once the desired amount of energy is delivered to the load, the LED-based lighting solution initiates on and off cycles of energy to maintain proper output regulation. Once the proper output regulation is reached, the LED-based lighting solution may suspend its on and off cycles. During this time, a bleeder circuit is used to maintain a load on the triac device.

The intelligent control as disclosed herein can reduce power dissipation of the bleeder circuit, while maintaining proper operation of a phase-cut dimmer switch and accurate detection of phase angle to maintain the correct light output related to dimming settings. A phase-angle sensor (discussed further below) in controller U1 detects when the AC input voltage crosses a preset value, such as when the voltage crosses, or is near, the zero line, 0V. When the AC input voltage is at or near the zero crossing, controller U1 may enable bleeder circuit 105. Bleeder circuit 105 is disabled while the switching cycles of the power switch transistor S1 have been enabled. In some embodiments, controller U1 may dissipate multiple levels of energy as desired. For example, during periods where the switching cycles are enabled, the input current to the SSL may still be below the holding current of the dimmer switch. In this case, a small amount of additional energy may be expended by bleeder circuit 105 to insure the triac remains in the on state while the power converter switching cycles are enabled. Once the switching cycles have been terminated, based on maintaining the desired output regulation, bleeder circuit 105 control operates as described herein. Another advantage of using the disclosed intelligent control is to avoid enabling bleeder circuit 105 when the amount of energy stored in the bulk capacitor is at the maximum for each AC half cycle. This increases the overall system efficiency while insuring the proper operation of the phase-cut dimmer.

Figure 4A:
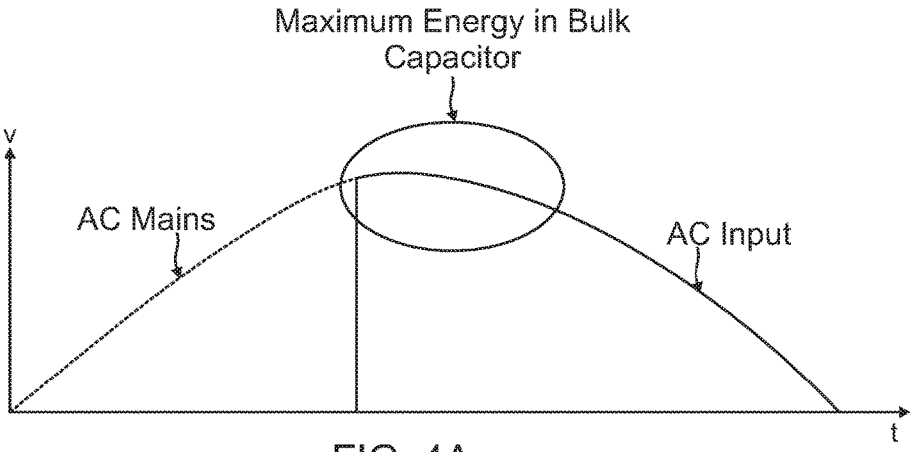
FIG. 4A illustrates the input voltage waveform from the rectification of an AC mains voltage for the SSL system of FIG. 1 in the presence of a leading-edge phase-cut dimmer application.
Figure 4B:
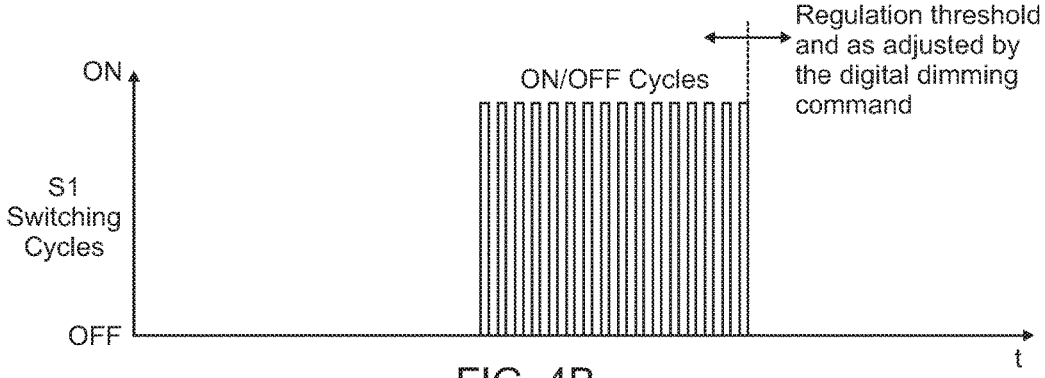
FIG. 4B illustrates the constant-peak-current pulses of the power switch in the SSL system of FIG. 1 in the presence of the leading-edge phase-cut dimmer application of FIG. 4A and as further adjusted by a digital dimming command.

Operation of this intelligent control will first be explained in the presence of analog dimming (phase-cut dimming) but with no digital dimming being applied by the user. This intelligent control is fundamentally the same regardless of whether phase-cut dimmer 300 is a leading-edge dimmer or a trailing-edge dimmer. The resulting current waveforms for a leading-edge dimmer application are shown in FIG. 4A and FIG. 4B. In particular, FIG. 4A shows a cycle of the rectified input voltage after application of a leading-edge dimming by leading-edge dimmer 300. The leading edge of the input voltage cycle starting from the zero crossing for the AC mains voltage is blocked by the triac while the triac is in the non-conducting state. After sensing the phase angle for the amount of leading-edge dimming applied through the triac in a previous cycle of the AC input voltage, controller U1 determines a number N of constant peak current pulses each having a peak current value of I_PEAK that is sufficient to maintain the input current to the LED fixture above the triac holding current. The intelligent control disclosed herein maintains the peak current I_PEAK at a constant value with each switching cycle, beginning at leading edge of the phase-cut input current as shown in FIG. 4B. For each switching cycle, U1 places the power switch transistor S1 in the off state when it reaches the constant I_Peak threshold. The I_Peak threshold is established to insure sufficient triac holding current. Dimming control is thus established through the number N of such constant peak current pulses. Adjusting the point at which the switching cycles are terminated within each AC half cycle, which is illustrated by a regulation threshold, provides output regulation. The I_Peak threshold may also be raised or lowered to provide a further means of output regulation.

Figure 4C:
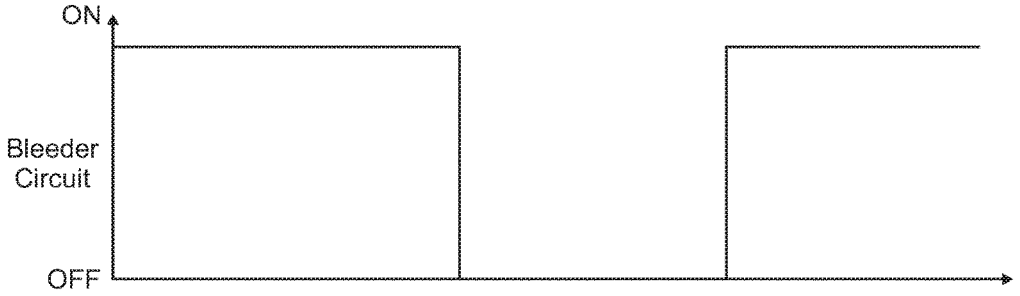
FIG. 4C illustrates the bleeder circuit operation for the SSL system of FIG. 1 in the presence of the leading-edge phase-cut dimmer application of FIG. 4A and as further adjusted by a digital dimming command.

Should a user adjust the dimming, the amount of leading edge cutting is adjusted accordingly through the dimmer setting (FIG. 3). To increase light output, the dimmer switch would be adjusted, effectively increasing the phase angle (decreasing the phase-cut). As the dimming is eliminated, the controller U1 may transition from the control scheme shown in FIG. 4B to the scheme discussed with regard to FIG. 2. This creates two problems, first, at the boundary between the two switching control schemes, there may be a noticeable light flicker. More problematic, if the dimmer switch setting caused a phase angle near the threshold where these control schemes are transitioned, there may be a constant back and forth transition between the control modes, causing light flicker even when the dimmer switch is in the steady state. Bleeder circuit 105 is maintained off during the switching cycles of FIG. 4B but may otherwise maintained be maintained on as shown in FIG. 4C.

To ease the transition from the constant peak current pulses of FIG. 4B to the current shaping control discussed with regard to FIG. 2, a hybrid control scheme may be implemented by controller U1 that combines current shaping and switching cycle modulation to ensure sufficient holding current to maintain proper operation of the dimmer switch, improve total harmonic distortion (THD) performance and thus increases power factor correction (PFC) even when connected via a phase-cut dimmer switch, provide a smooth control transition from the various control schemes, prevent any light flicker, and insure consistent performance across multiple types of dimmer switches (e.g. leading, trailing, leading/trailing).

One example hybrid control scheme includes the following control modes:

1) Control mode A describes AC current shaping when connected directly to the AC mains (no phase-cut dimming being applied by the user) as discussed with regard to FIG. 2

2) Control mode B corresponds to the fixed peak current pulses of FIG. 4B, and 3) Control mode C corresponds to a hybrid control mode, which includes partial I_Peak current shaping, improving THD characteristics while also insuring sufficient load current. This allows for improved THD characteristics and for smooth transitioning between control modes A and B.

Figure 5A:
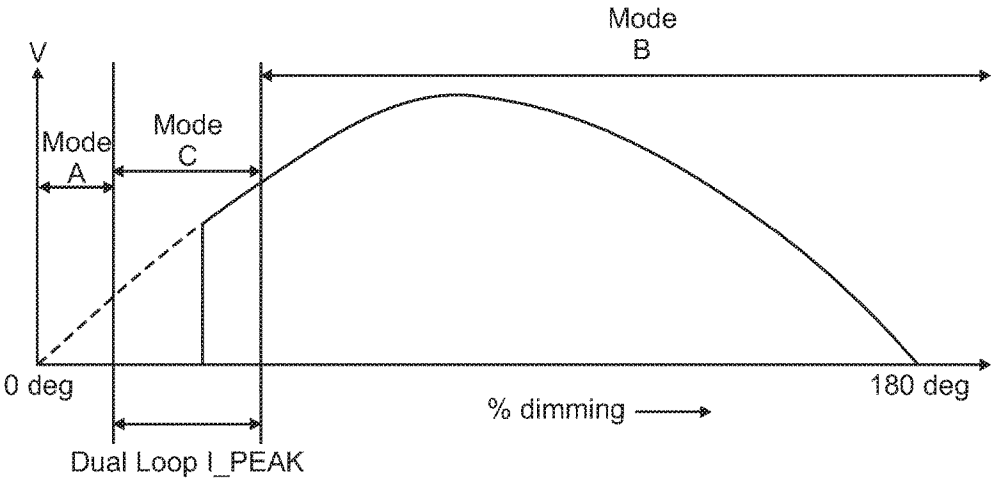
FIG. 5A illustrates the division of an input voltage waveform from the rectification of an AC mains voltage into a no-dimming range, a hybrid dimming range, and a constant-peak-current dimming range.

FIG. 5A shows an example mode assignment for a half wave of the AC input voltage. Between the zero crossing and a relatively minor percentage for the trailing edge dimming, control mode A is applied. From the relatively minor percentage to a greater percentage application of the leading-edge dimming, control mode C is applied by controller U1. Finally, from edge of the control mode C to a 100% dimming application, controller U1 applies control mode B. The regime for control mode B C may also be denoted as "dual loop I_PEAK" regime since it involves the application of both current shaping and also maintaining a certain minimum value for each current pulse to assure that a sufficient triac holding current is conducted.

Figure 5B:
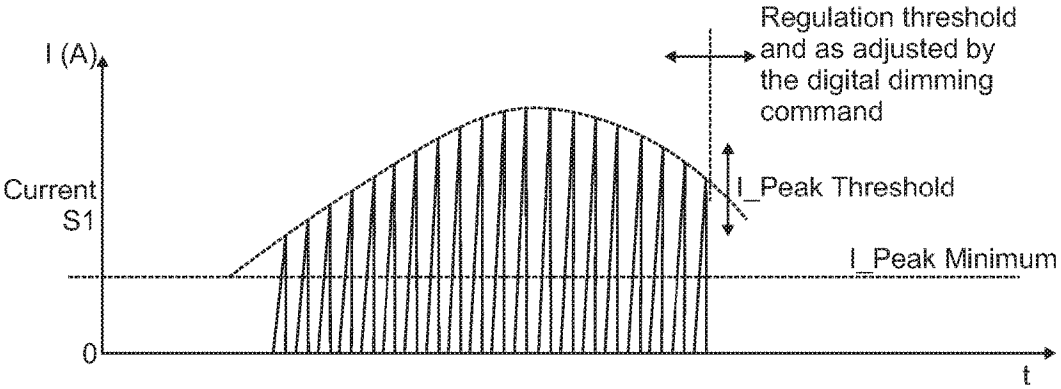
FIG. 5B illustrates the current pulses through the power switch for the hybrid dimming range of FIG. 5A.

FIG. 5B illustrates the current pulses for an example of the control mode C corresponding to the leading-edge dimming application shown in FIG. 5A. The peak current of each pulse is above a minimum value (I_Peak minimum) that guarantees that the triac holding current is maintained. Given this minimum, the peak current is then shaped according to the input current cycle. Adjusting the I_Peak threshold and/or the number N of current pulses in mode C provides output regulation. Use of control mode C can provide improved total harmonic distortion (THD) performance when a phase-cut dimmer switch is used because it may allow for a smoother transition from modes A and B during events when the dimmer switch setting is adjusted. For example, going from a large phase-cut (low light output) to a small, or no phase-cut (maximum light output) would correspond to a transition from mode B to mode C and then from mode C to mode A. Conversely, a transition from no dimming to a sufficiently large amount of dimming would correspond to a transition from mode A to mode C and from mode C to mode B.

Figure 6:
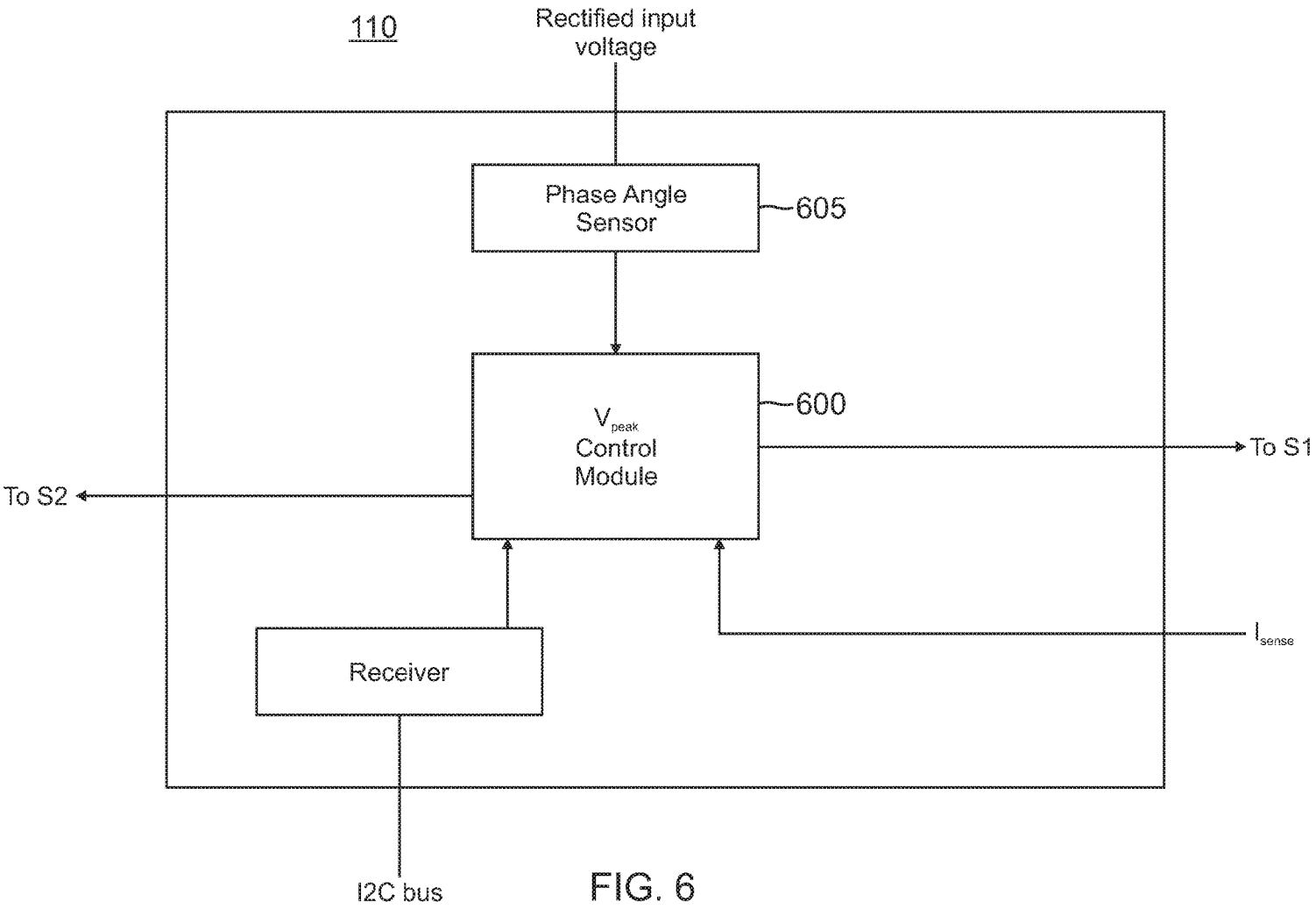
FIG. 6 is a more detailed block diagram for the primary controller in the SSL system of FIG. 1.

Controller U1 is shown in more detail in FIG. 6. A phase angle sensor 605 receives the rectified input voltage (or a divided version or this voltage) to calculate the amount of phase cut dimming with regard to the zero crossing of the AC mains input voltage. A peak current (Vpeak) control module 600 controls the on and off cycling of power switch transistor S1 responsive to the Isense input. In control mode B (in the presence of a significant amount of trailing edge dimming for example) peak current control module 600 thus responds to the amount of leading-edge dimming detected by phase angle sensor 605 in one cycle of the rectified input voltage to calculate the number N of constant peak current pulses that will be applied in the subsequent cycle of the rectified input voltage. Advantageously, peak current control module 600 is further configured to reduce this number N in the presence of a digital dimming command such as received over an I2C bus at a receiver 610. Referring again to FIG. 4B, peak current control module 600 would implement a number N of constant peak current pulses in the absence of any digital dimming. But peak current control module 600 would then reduce this number N of constant peak current pulses responsive to the application of a digital dimming command. For example, should the digital dimming command call for a dimming of 50%, peak current control module 600 may reduce by 50% the number N of constant current pulses that follow the leading edge of the analog dimming as set by the triac. Peak current control module 600 also controls the on and off state of bleeder switch transistor S2 such that this transistor is off during the constant peak current pulses but is otherwise turned on in the remainder of the rectified input voltage cycle as shown in FIG. 4C. In this fashion, analog and digital dimming is combined without the conventional problems of flicker and resetting of the triac.

Figures 7A, 7B, 7C:
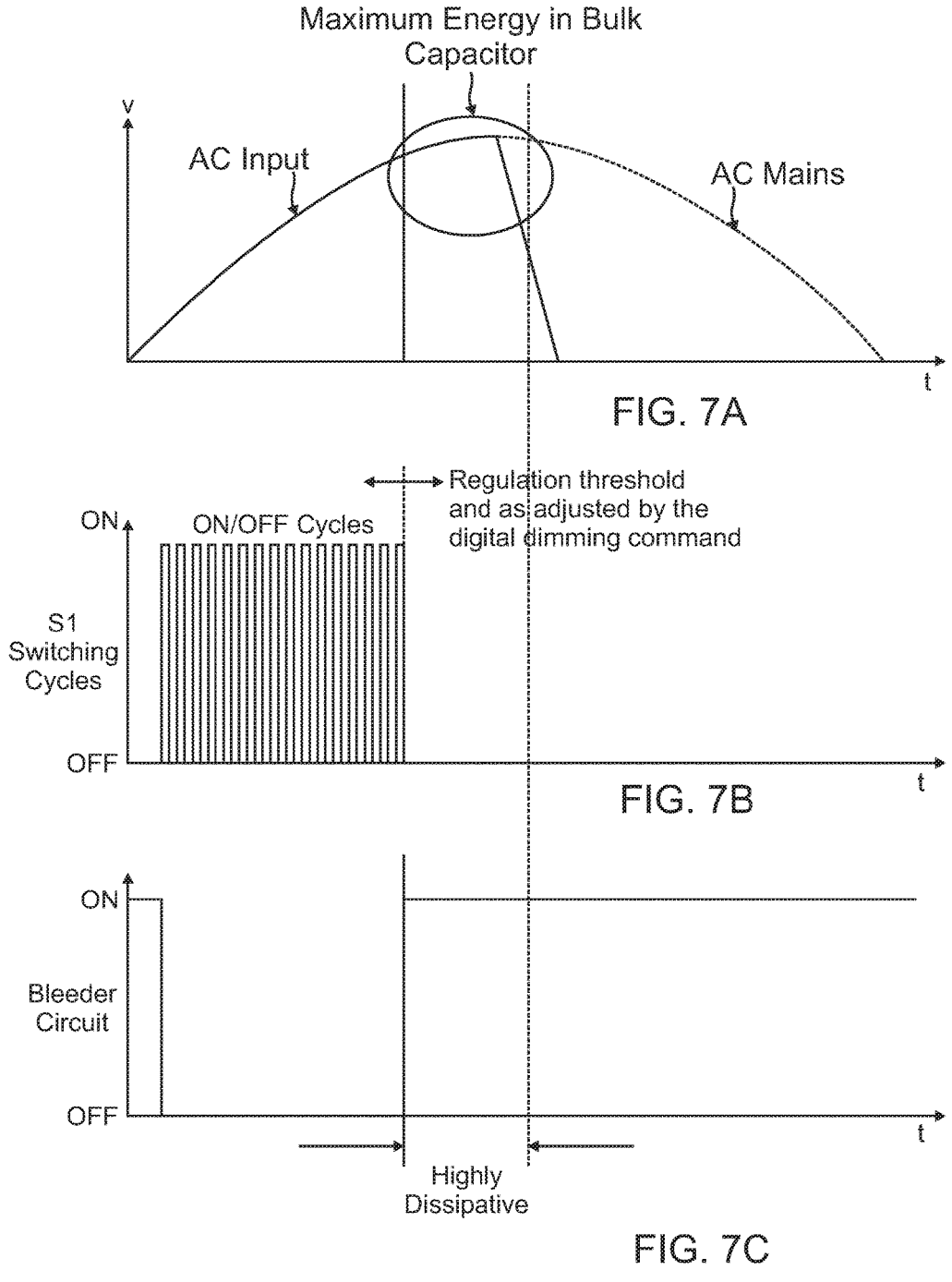
FIG. 7A illustrates the input voltage waveform from the rectification of an AC mains voltage for the SSL system of FIG. 1 in the presence of a trailing-edge phase-cut dimmer application.
FIG. 7B illustrates the constant-peak-current pulses of the power switch in the SSL system of FIG. 1 in the presence of the trailing-edge phase-cut dimmer application of FIG. 7A and as further adjusted by a digital dimming command.
FIG. 7C illustrates the bleeder circuit operation for the SSL system of FIG. 1 in the presence of the trailing-edge phase-cut dimmer application of FIG. 7A and as further adjusted by a digital dimming command.

The combination of digital dimming with a trailing-edge analog dimmer will now be discussed. FIG. 7A illustrates a cycle for the rectified input voltage in the presence of a trailing-edge dimmer application. Peak current control module 600 operates analogously as discussed with regard to leading-edge dimming in that it would calculate a number N of constant current pulses to be applied in the current cycle for the rectified input voltage based upon the detected phase angle. Advantageously, this number N may then be adjusted based upon the application of a digital dimming command (if present).

Figure 7D:
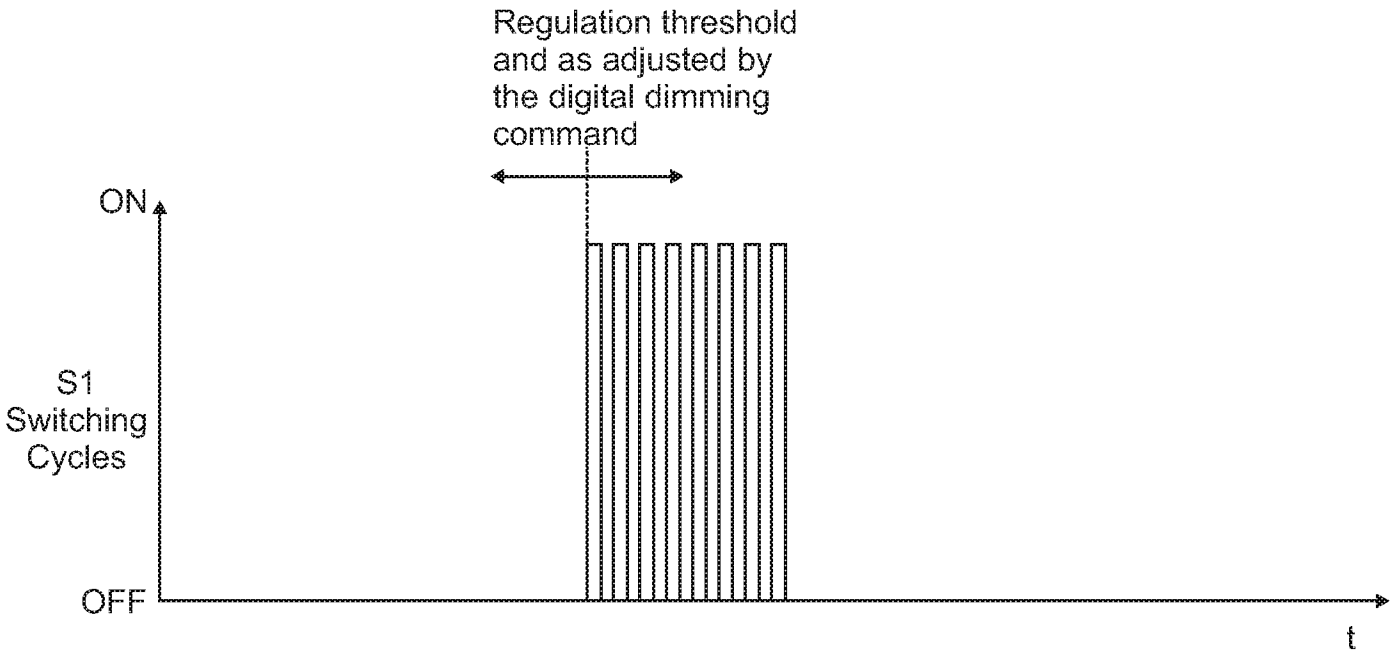
FIG. 7D illustrates the repositioning of the constant-peak-current pulses of FIG. 7B so as to be located in the maximum-voltage range for the input voltage waveform of FIG. 7A.

As shown in FIG. 7B, the constant current pulses may start from the zero crossing of the AC mains input voltage. Controller U1 maintains bleeder circuit 105 off while the constant current pulses are active but otherwise maintains bleeder circuit 105 on as shown in FIG. 7C. Note, however, that bleeder circuit operation then occurs while there is a maximum amount of energy stored in the output capacitor C2 (FIG. 1) as highlighted in FIG. 7A. To prevent this energy dissipation, controller U1 may be configured to move the constant current pulses such that they end near the trailing edge of the rectified input voltage as determined by the amount of trailing-edge dimming as shown in FIG. 7D. In this fashion, bleeder circuit 105 will not be cycled on during the most dissipative portion of the rectified input voltage cycle, which advantageously reduces power consumption.

Figure 8:
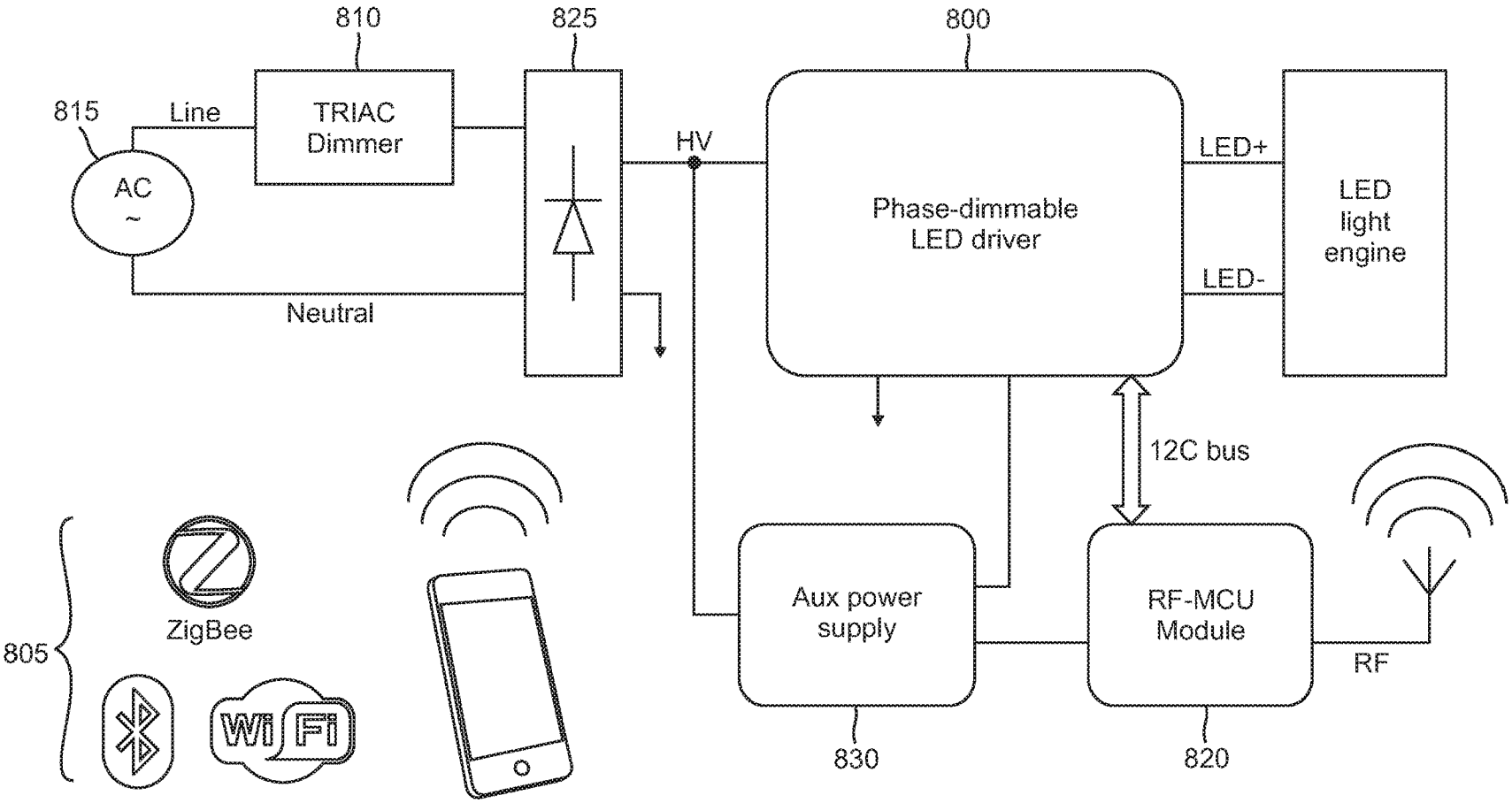
FIG. 8 illustrates the SSL system of FIG. 1 integrated with a wireless receiver configured to receive the digital dimming command.

To receive a wireless digital dimming command, a switching power converter LED driver 800 such as the buck-boost converter discussed with regard to FIG. 1 is associated with an RF receiver such as an RF-MCU module 820 as shown in FIG. 8. A wireless device 805 (i.e. a smart phone, tablet, digital controller, or another digital equivalent input source) provides a digital dimming command to RF-MCU module 820 using a suitable wireless protocol such as ZigBee, Bluetooth, or WiFi. A triac dimmer 810 coupled to an AC mains 815 may be a leading-edge, trailing-edge, leading-trailing, and/or another phase-cut dimmer. A diode bridge 825 rectifies the resulting phase-cut input voltage and current from triac dimmer 810 regardless of the phase of the applied dimming (i.e. full phase, partial phase, or minimum phase). Should the user apply no digital dimming, LED driver 800 operates as discussed previously. RF-MCU 820 module communicates with LED driver 800 over a suitable interface such as an I2C bus. An auxiliary power supply 830 provides a power supply voltage to the LED driver 800 and RF-MCU module 820 by regulating from the rectified input voltage.

LED driver 800 includes the controller U1 discussed previously. Based upon the digital dimming command from RF-MCU module 820, controller U1 adjusts the number of current pulses from whatever value the phase cut angle provides. In other words, a given phase cut maps into a given number of constant peak current pulses (which may be current shaped in mode C for a suitable range of phase angle as discussed above). This number of pulses is further adjusted based upon the digital dimming command.

Figure 9:
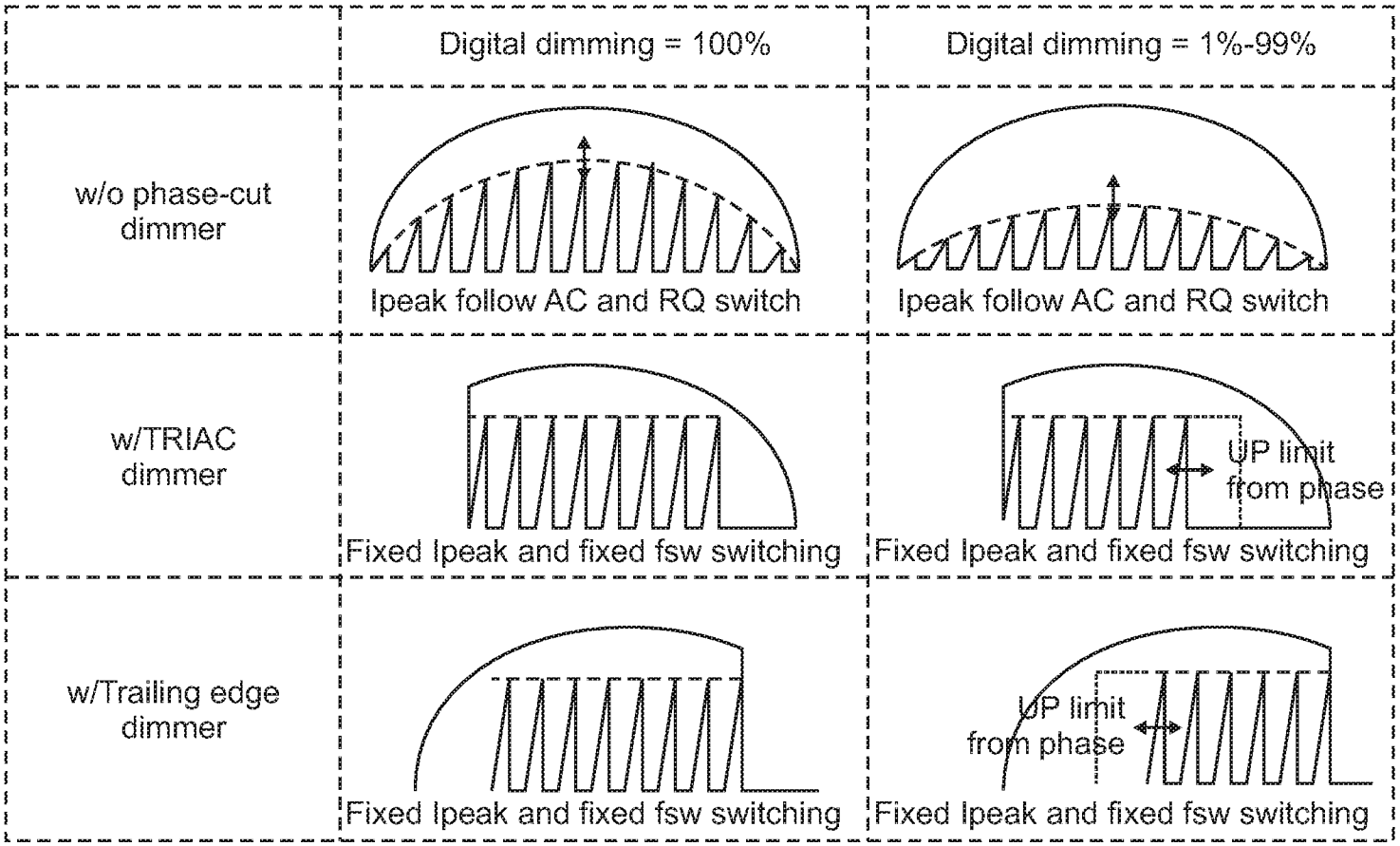
FIG. 9 illustrates the current waveforms for with and without digital dimming in the absence of a phase-cut dimmer, with and without digital dimming with a leading-edge phase-cut dimmer, and with and without digital dimming with a trailing-edge phase-cut dimmer.

The resulting advantageous combination of phase cut dimming and digital dimming may be summarized with regard to FIG. 9, which is organized into two columns. The left-most column corresponds to no digital dimming whereas the right-most column corresponds to the application of some degree of digital dimming (e.g., 1 to 99% of the maximum available power). FIG. 9 is also organized into three rows. An upper-most row corresponds to no phase-cut dimming A middle row corresponds to the application of a leading edge phase-cut dimmer whereas the bottom row corresponds to the application of a trailing-edge phase-cut dimmer. The upper row thus corresponds to the current shaping control discussed with regard to FIG. 2. The application of leading-edge or trailing edge dimming without any digital dimming thus corresponds to FIGS. 4B and 7D, respectively. The application of leading-edge or trailing edge dimming in the presence of digital dimming similarly corresponds to FIGS. 4B and 7D, respectively. As shown in FIG. 9, the addition of digital dimming reduces the number of constant peak current pulses in both the leading-edge and trailing-edge dimming applications.

In one embodiment, external digital control is set as a high priority but uses the phase-cut dimmer angle as the upper limit on light output. In this control scheme, external digital control cannot go above the dimmer phase determined limit; however, external digital control can adjust the output downward by adjusting the regulation threshold, thereby adjusting the number of PMW pulses. External digital control can work at any phase angle of the phase-cut dimmer to regulate LED output (i.e. operational state, brightness/current, and/or color/temperature).

In another embodiment of, phase-cut dimmer angle is set as a high priority, but external digital control is set as the upper limit. The phase-cut dimmer angle is limited by the external digital control determined upper limit; however, phase-cut dimming can adjust the output downward by adjusting the phase-cut dimmer angle. External digital control can work at any phase angle of the phase-cut dimmer to regulate LED output (i.e. operational state, brightness/current, and/or color/temperature).

In yet another embodiment, the regulation threshold/dimming ratio is the product of the external digital control ratio and phase-cut dimming ratio. External digital control can work at any phase angle of the phase-cut dimmer to regulate LED output (i.e. operational state, brightness/current, and/or color/temperature).

In another embodiment, the phase-cut dimmer angle can be used to adjust warm or cool LED color temperature (i.e. lower dimmer phase to achieve warmer light color). The warmer versus cooler light control could also be reversed where the low dimming phase is cooler, and this control method would still fall under the spirit and intent of this invention.

In another embodiment, more than one phase-cut dimmer is connected to the LED-based lighting solution. In another embodiment, more than one external digital control is connected to the LED-based lighting solution. In yet another embodiment, a combination of one or more phase-cut dimmers and one or more digital dimmer control interfaces are connected to the LED-based lighting solution. In yet another embodiment, an external digital control can be replaced by an analog dimming signal. In yet another embodiment, the external digital control interface can be replaced by a variable voltage (i.e. 0-10 v) dimmer signal. In yet another embodiment, the last adjustment dimmer source, whether it is phase-cut dimmer or external digital control, determines the final regulated LED current.

As those of some skill in this art will by now appreciate and depending on the particular application at hand, many modifications, substitutions and variations can be made in and to the materials, apparatus, configurations and methods of use of the devices of the present disclosure without departing from the scope thereof. In light of this, the scope of the present disclosure should not be limited to that of the particular embodiments illustrated and described herein, as they are merely by way of some examples thereof, but rather, should be fully commensurate with that of the claims appended hereafter and their functional equivalents.

We claim:

1. A controller for controlling an LED-based lighting system comprising:

a phase angle sensor configured to detect a phase angle from a phase-cut dimmer as applied to cycles of a rectified input voltage;

a receiver for receiving a digital dimming command; and a peak current control module configured to calculate a first number of constant peak current pulses to be driven through a power switch in a current one of the cycles of the rectified input voltage responsive to the phase angle detected in a subsequent one of the cycles of the rectified input voltage, wherein the peak current control module is further configured to reduce the first number of constant peak current pulses into a second number of constant peak current pulses responsive to the digital dimming command received by the receiver, and wherein the peak current control module is further configured to cycle the power switch on and off according to the second number of constant peak current pulses in the current one of the cycles of the rectified input voltage.

2. The controller of claim 1, wherein the peak current control module is further configured to switch on a bleeder switch while the power switch is not cycled on and off and to switch off the bleeder switch while the power switch is cycled on and off.

3. The controller of claim 1, further comprising an I2C bus for receiving the digital command.

4. The controller of claim 1, wherein the power switch is a power switch for a buck-boost switching power converter.

5. The controller of claim 1, wherein the phase-cut dimmer is a leading-edge phase cut dimmer, and wherein the peak current control module is further configured to begin cycling the power switch at a leading edge of the rectified input voltage.

6. The controller of claim 1, wherein the digital dimming command is based at least in part on a signal from a mobile device or tablet.

7. The controller of claim 1, wherein the phase-cut dimmer is a trailing-edge phase-cut dimmer, and wherein the peak current control module is further configured to begin cycling the power switch at a beginning of the current one of the cycles of the rectified input voltage.

8. A method of controlling the output to at least one solid state lighting device in a LED-based lighting solution comprising:

receiving cycles of a rectified input voltage having a phase-cut dimming;

receiving a digital dimming command;

determining a first number of constant peak current pulses to be driven through an LED in a current one of the cycles of the rectified input voltage responsive to a phase-cut angle for a subsequent one of the cycles of the rectified input voltage;

reducing the first number of constant peak current pulses into a second number of constant peak current pulses responsive to the digital dimming command; and cycling a power switch to drive the second number of constant peak current pulses through the LED in the current one of the cycles of the rectified input voltage.

9. The method of claim 8, wherein an off-time for each cycle of the power switch is responsive to a sense voltage across a sense resistor in series with the power switch indicating that a peak current for each of the constant peak current pulses has been reached.

10. The method of claim 8, wherein receiving the digital dimming command comprises receiving the digital dimming command over an I2C bus.

11. The method of claim 10, wherein receiving the digital dimming command further comprises receiving a wireless digital dimming command at an RF receiver to form the digital dimming command.

12. The method of claim 11, wherein receiving the wireless digital dimming command comprises receiving the wireless digital dimming command from a mobile device or a tablet.

13. The method of claim 8, wherein the phase-cut dimming is a leading-edge phase-cut dimming, and wherein cycling the power switch comprises cycling the power switch beginning at a leading edge of the leading-edge phase-cut dimming in the current one of the cycles of the rectified input voltage.

14. The method of claim 8, wherein the phase-cut dimming is a trailing-edge phase-cut dimming, and wherein cycling the power switch comprises cycling the power switch at a beginning of the current one of the cycles of the rectified input voltage.

15. The method of claim 8, wherein the phase-cut dimming is a trailing-edge phase-cut dimming, and wherein cycling the power switch comprises finishing the cycling the power switch at a trailing edge of the current one of the cycles of the rectified input voltage.

16. The method of claim 8, further comprising switching on a bleeder switch transistor while the power switch is not cycled in the current one of the cycles of the rectified input voltage.

17. The method of claim 16, further comprising switching off the bleeder switch transistor while the power switch is cycled in the current one of the cycles of the rectified input voltage.

18. The method of claim 8, wherein cycling the power switch comprises cycling a power switch in a buck-boost switching power converter.

* * * * *